US006310017B1

(12) United States Patent
Grant et al.

(10) Patent No.: US 6,310,017 B1
(45) Date of Patent: Oct. 30, 2001

(54) CLEANER COMPOSITION, METHOD FOR MAKING AND USING SAME

(75) Inventors: Donald C. Grant, Excelsior; Mark R. Litchy, Plymouth, both of MN (US)

(73) Assignee: CT Associates, Inc., Excelsior, MN (US)

( * ) Notice: Subject to any disclaimer, the term of this patent is extended or adjusted under 35 U.S.C. 154(b) by 0 days.

(21) Appl. No.: 09/241,196

(22) Filed: Feb. 1, 1999

(51) Int. Cl.[7] ..... C11D 7/18; C23G 1/02
(52) U.S. Cl. ..... 510/175; 134/2; 134/3
(58) Field of Search ..... 134/1, 1.1, 2, 3, 134/6, 42, 424; 510/175, 176; 210/754, 760, 787; 252/626; 423/20, 6, 251, 252

(56) References Cited

U.S. PATENT DOCUMENTS

| | | | |
|---|---|---|---|
| 2,154,451 | | 4/1939 | Hull . |
| 2,154,455 | | 4/1939 | Kepfer . |
| 2,154,468 | | 4/1939 | Oplinger . |
| 2,613,141 | | 10/1952 | Cochran . |
| 2,689,785 | | 9/1954 | Simon . |
| 2,860,039 | | 11/1958 | Margulies et al. . |
| 3,412,032 | | 11/1968 | Jenks . |
| 4,086,128 | | 4/1978 | Sugio et al. . |
| 4,105,253 | | 8/1978 | Showalter . |
| 4,614,596 | * | 9/1986 | Wyness . |
| 5,205,999 | * | 4/1993 | Willis et al. . |
| 5,632,866 | | 5/1997 | Grant . |
| 5,909,745 | * | 6/1999 | Ali et al. . |
| 6,074,276 | * | 7/2000 | Shibata et al. . |
| 6,110,830 | * | 8/2000 | Skrovan et al. . |

FOREIGN PATENT DOCUMENTS

| | | | |
|---|---|---|---|
| 404090891A | * | 3/1992 | (JP) . |
| 11186207A | * | 7/1999 | (JP) . |
| 11197678-A | * | 7/1999 | (JP) . |

* cited by examiner

*Primary Examiner*—Yogendra N. Gupta
*Assistant Examiner*—Gregory E. Webb
(74) *Attorney, Agent, or Firm*—Skinner and Associates

(57) ABSTRACT

A cleaning solution composition for use on electronic component and equipment employed in the cleaning of these components. The cleaning solution comprises ultrapure water containing carbonic acid plus an oxidizing agent selected from hydrogen peroxide, ozone, and combinations thereof. The invention includes a method of removing contaminants from electronic components, containers and associated equipment using the cleaning solution of novel composition. Further, the invention includes a method of preparing the novel cleaning solution composition by contacting carbon dioxide gas with ultrapure water and adding an oxidizing agent, or by contacting carbon dioxide gas with an ultrapure water solution of oxidizing agent.

9 Claims, 1 Drawing Sheet

CLEANER COMPOSITION, METHOD FOR MAKING AND USING SAME

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates, generally, to a cleaning solution composition and a method of making and using the cleaning solution composition. More particularly, the invention relates to an acidic cleaning solution composition containing an oxidizing agent, and a method of making and using the acidic oxidizing cleaning solution.

2. Background Information

The semiconductor industry employs extensive cleaning regimens in the production of various electronic components, such as printed circuit boards and devices, as well as the precursors therefor, such as chips and wafers. Various cleaning and rinsing steps are used to remove contaminants from these components during fabrication, since even minute contaminants can interfere with the operation of the electronic components. The materials used to clean the components include ultrapure water, and aqueous solutions of various cleaning agents, including acidic, neutral, and basic substances, as well as organic solvents, both polar and nonpolar. The contaminants targeted for removal from the electronic components include inorganic compounds, such as metal salts, organic substances, such as grease or oil, and particulate material. Particles can cause open or short circuits and non-integral dielectric films in semiconductor devices. Organic and inorganic contaminants, both metallic and nonmetallic, can result in poor dielectric film quality with decreased device performance and reliability. Metallic contaminants can be especially damaging. Taken as a whole, contaminants result in a large portion of yield loss in the manufacture of electronic components.

In addition, the purity of the cleaning and rinsing substances used to remove the contaminants must be controlled to prevent contamination of the electrical component being treated. Also, the containers and equipment used in the cleaning and rinsing processes must not contribute contaminants to the system. For instance, the present total allowable metal ion concentration in chemicals used for the semiconductor industry is 5 parts per billion (ppb). It is estimated that the purity of chemicals must improve 10-fold approximately every 6 years. Thus, both the chemicals used and the equipment employed to handle the chemicals must be extensively free from contaminants.

Since metal ions are particularly undesirable semiconductor contaminants, metallic containers are generally avoided for cleaning liquids. Plastic containers, and, in particular, perfluorinated organic polymer based containers, are widely used for this purpose. These containers are subject to both surface and bulk contamination where contaminants are desorbed from the surface or bulk of the perfluorinated polymer based container.

There are numerous approaches to cleaning components and many issues which must be considered in selecting the best approach. Safety and environmental concerns must be addressed, as well as the effectiveness of the cleaning technology for providing clean components. Cleaning effectiveness considerations need to include the ability to remove particles, inorganic materials, and organic materials. Cleaning agents should be easily removed from the component and not leave a substantial residue. In addition, components must dry without "spotting".

Safety concerns include cleaning agent toxicity and flammability. Environmental concerns include the release of hazardous air pollutants (HAPs), volatile organic compounds (VOCs), ozone depleting solvents (ODSs) and compounds which have a high global warming potential (GWP).

The major variables which control cleaning effectiveness are the solution chemistry (including temperature) and the use of mechanical energy. Chemistries which are commonly used include aqueous solutions (with and without surfactants), semiaqueous solutions (water and organic solvent mixtures), organic solvents, hydrofluorocarbons and co-solvent systems. Mechanical energy can be imparted to the cleaning solution using ultrasonic transducers, megasonic transducers, carbon dioxide snow, high pressure spray, and the like.

The state of the art generally includes various devices, methods and compositions for removing contaminants from components and material used to clean these components. The complexity of the selection process is described in a paper by Kanegsberg and Seelig entitled "Precision Cleaning Options for the '90s" published in Precision Cleaning '96 Proceedings, pp. 224–235.

These devices and methods are believed to have significant limitations and shortcomings. Specifically, cleaning solutions may contain corrosive, toxic and difficult to dispose of materials. An ideal cleaning solution should be easy to prepare on-site, comparatively safe and nontoxic in use, and conveniently decomposed to innocuous products for disposal.

Applicant's invention provides a cleaning solution composition, as well as a method of making and using the cleaning solution, which are believed to constitute an improvement over the prior art.

BRIEF SUMMARY OF THE INVENTION

The present invention provides a cleaning solution composition for use on electronic components and equipment employed in the cleaning of these components. The cleaning solution comprises ultrapure water containing carbonic acid plus an oxidizing agent selected from hydrogen peroxide, ozone, and combinations thereof. The invention includes a method of removing contaminants from electronic components, containers and associated equipment using the cleaning solution of novel composition. Further, the invention includes a method of preparing the novel cleaning solution composition by contacting carbon dioxide gas with ultrapure water and adding an oxidizing agent, or by contacting carbon dioxide gas with an ultrapure water solution of oxidizing agent.

The features, benefits and objects of this invention will become clear to those skilled in the art by reference to the following description, claims and drawings.

DETAILED DESCRIPTION

Figure 1:
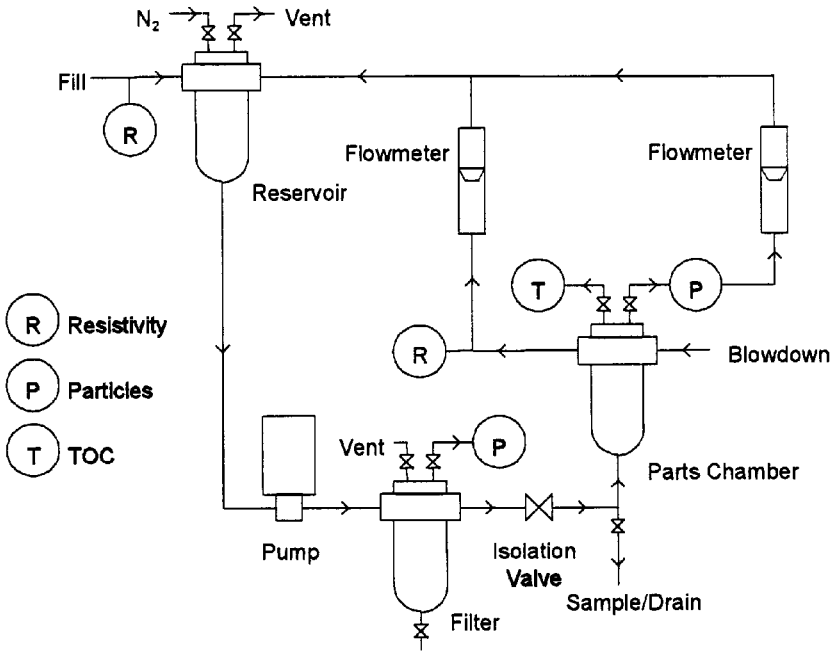
FIG. 1 is a schematic diagram of a multi-component dynamic extraction test system used to evaluate cleaning solution performance.

The present invention comprises a cleaning solution composition for removing contaminants from electrical components, as well as from containers and associated equipment employed in the cleaning process for these components. In addition, the invention includes a method of removing contaminants from components, containers or associated equipment using the cleaning solution of novel composition. Finally, the invention includes a method of preparing the novel cleaning solution composition.

1. Cleaning Solution Composition

The cleaning solution composition of the present invention comprises a solution of ultrapure water plus carbonic acid and an oxidizing agent. The oxidizing agent is selected from the group consisting of hydrogen peroxide, ozone and a combination of hydrogen peroxide plus ozone. Each of these components is commercially available in high purity form, or is easily prepared from high purity materials so as to produce a material suitable for use in cleaning electrical components and associated equipment.

Carbonic acid is formed in situ by contacting ultrapure water with carbon dioxide gas. Carbon dioxide reacts with water to form carbonic acid according to equation 1.

$$CO_2+H_2O \rightarrow H_2CO_3 \quad (1)$$

Carbonic acid is a weak acid and, in water, dissociates to form hydronium ions and bicarbonate ions according to equation 2.

$$H_2CO_3+H_2O \rightarrow H_3O^+ + HCO_3^- \quad (2)$$

Thus, an aqueous carbonic acid solution will exhibit an acidic pH, that is, a pH less than 7.0. Bicarbonate ion does not dissociate to hydronium ions and carbonate ions to any measurable extent unless the pH of the aqueous solution is made quite basic, a pH greater than 7.0, by addition of a strong base that provides hydroxide ions. The carbonic acid concentration of such solutions can be indirectly determined by measuring the pH of the these solutions. As additional carbon dioxide reacts to produce additional carbonic acid, equation 2 is driven to form higher concentrations of reaction products, hydronium ions and bicarbonate ions. Since pH measures solution hydronium ion concentration, carbonic acid solution content is indirectly measured. The more acidic (lower pH) the carbonic acid solution, the higher the concentration of carbonic acid contained therein.

The measured ionization constant for an aqueous solution of carbonic acid is $K_1=4.45\times10^{-7}$. Using this ionization constant value, aqueous solutions containing 0.1, 1.0 or 10 moles/liter of carbonic acid are calculated to have a pH of 3.7, 3.2 or 2.7 respectively. Thus, the most acidic pH attainable for an aqueous carbonic acid solution alone is 2.0 or higher.

Carbon dioxide is commercially available in high purity with the material available in pressurized cylinders ranging in size from hand carried lecture bottles to rail car sized pressure vessels.

To produce the cleaning solution, sufficient carbon dioxide is contacted with the ultrapure water to produce a carbonic acid solution of pH in the range 2.0 to about 6.0. Preferably, sufficient carbon dioxide is contacted with the ultrapure water to produce a carbonic acid solution of pH in the range 2.0 to about 5.0. Most preferably, sufficient carbon dioxide is contacted with the ultrapure water to produce a carbonic acid solution of pH in the range 2.0 to about 4.5.

The oxidizing agent added to the carbonic acid solution is selected from the group consisting of hydrogen peroxide, ozone and hydrogen peroxide plus ozone. Hydrogen peroxide is available as electronic grade high purity material, in the form of aqueous solutions up to about 70% hydrogen peroxide by weight. Sufficient hydrogen peroxide is added to the above described carbonic acid solution to produce a hydrogen peroxide concentration of about 1% to 10% by weight. Preferably hydrogen peroxide is added to produce a hydrogen peroxide concentration of about 4% to 6% in the carbonic acid solution. Most preferably hydrogen peroxide is added to produce a hydrogen peroxide concentration of about 5% in the carbonic acid solution.

Alternatively, hydrogen peroxide solution can first be added to ultrapure water and the resulting solution contacted with carbon dioxide gas to generate carbonic acid in solution, thus producing a cleaning solution having the desired pH range.

Ozone is another oxidizing agent which can be added to the carbonic acid solution to produce a suitable cleaning solution composition. Ozone is a gas at ambient conditions and is an extremely powerful oxidizing agent. The high reactivity of ozone necessitates that ozone be generated at the point of use. Ozone is routinely produced on site by commercially available ozone generator devices. Air, oxygen-enriched air, or pure oxygen is subjected to a corona discharge in the ozone generator to produce a gas containing up to about 10% ozone. The ozone-containing gas is contacted with the carbonic acid aqueous solution to dissolve all or a portion of the ozone in that solution. Preferably, the resulting cleaning solution contains at least about 1 mg/l of dissolved ozone as the oxidizing agent. Most preferably, the carbonic acid solution is saturated with ozone.

Alternatively, ozone can first be added to ultrapure water and the resulting solution contacted with carbon dioxide gas to generate carbonic acid in solution, thus producing a cleaning solution having the desired pH range.

In a further embodiment of the invention, a combination of hydrogen peroxide and ozone is employed as the oxidizing agent of the cleaning solution composition. Preferably, the hydrogen peroxide is added to produce a hydrogen peroxide concentration of about 4% to 6% in the carbonic acid solution, and ozone is added to produce an aqueous solution saturated with ozone. Again, the carbonic acid may be generated in solution before or after addition of the oxidizing agent or agents.

The combination of an aqueous solution of carbonic acid and an oxidizing agent selected from hydrogen peroxide, ozone and hydrogen peroxide plus ozone, has been found to be a highly effective composition for cleaning electrical components, as well as containers and other equipment employed in the electronics industry. Not only is the cleaning solution composition effective in removing contaminants, but the spent cleaning solution is easily and economically treated to render it innocuous. Solutions of carbonic acid and hydrogen peroxide can be neutralized by simply maintaining the solution at an elevated temperature. Heat will readily decompose hydrogen peroxide to oxygen and water and convert carbonic acid to carbon dioxide gas. Carbonic acid and ozone can also be removed from solution by sparging with an inert gas, such as nitrogen. Ozone can easily be decomposed by either heating the solution or by treating the solution with UV radiation.

2. Method of Making and Using Cleaning Solution

Several methods of making the novel composition cleaning solution have been briefly mentioned above. In one embodiment, carbon dioxide gas is contacted with ultrapure water to produce a solution of carbonic acid of the desired solution pH. Preferably carbon dioxide gas is sparged into water to bring about carbonic acid formation. Next, an oxidizing agent is added to the carbonic acid solution to produce the novel cleaning solution. The oxidizing agent may be hydrogen peroxide, ozone or a combination of hydrogen peroxide plus ozone. Hydrogen peroxide is added in the form of an aqueous solution while ozone is generated in a gaseous mixture with air or oxygen, and the mixture is contacted with the carbonic acid solution. Preferably, the gas mixture is sparged into the carbonic acid solution to dissolve the ozone therein. A combination of hydrogen peroxide plus ozone requires separate addition steps for each oxidant.

In another embodiment, the novel cleaning solution is prepared by first adding the oxidizing agent or agents to ultrapure water to produce a solution of oxidizing agent, and then contacting carbon dioxide gas with the oxidizing agent solution to produce carbonic acid therein, and thus produce the desired cleaning solution.

The invention also includes a method of removing contaminants from contaminated items using the novel cleaning solution. The steps include providing the cleaning solution of ultrapure water, carbonic acid and oxidizing agent, contacting contaminated items with the cleaning solution for a selected time period to remove contaminants, and removing the items from contact with the cleaning solution to produce items with reduced contaminants. Preferably, the items are contacted with the cleaning solution by immersion of the items in the solution. In a further embodiment of the process, the cleaning solution is heated to a selected temperature during the item contacting step. The duration of the contacting step is approximately one hour, and preferably at least one hour, although shorter times may be desirable. The duration of the contacting step may be in excess of twenty-four hours in certain applications. The selected temperature to which the cleaning solution is heated during the contacting step is preferably about 50 degrees C., and most preferably is about 80 degrees C.

The following examples should be interpreted in the illustrative and not the limited sense with regard to the present invention.

EXAMPLE I

It is imperative to minimize the contaminants that enter the chemical cleaning reagents which are used to clean electronic components. A significant source of contaminants is the containers and associated equipment used in handling the chemical cleaning reagents. In order to assess the efficiency of various cleaning compositions and contacting regimens, samples of plastic parts used in semiconductor fluid handling systems were subjected to a variety of cleaning compositions and the effectiveness of each determined. Techniques were developed to measure inorganic, organic and particulate contaminants in parts made from different polymers with different geometries and fabrication histories. Polymers investigated included polytetrafluoroethylene (PTFE), perfluoroalkoxy (PFA) and polyvinylidenedifluoride (PVDF). Geometries examined include large, flat surfaces and various small complex parts. The parts were fabricated by machining or injection molding.

The cleaning methods initially evaluated are described in Table 1.

TABLE 1

Cleaning Methods Evaluated

| Cleaning procedure | Description | Chemical Composition | Temp, ° C. | Time, minutes |
|---|---|---|---|---|
| None | | | Ambient | — |
| Carbonated peroxide | A mixture of hydrogen peroxide and carbon dioxide in ultrapure water in a circulating bath. | 5% $H_2O_2$ in UPW pH = 4.5 | Ambient | 60 |
| Hot carbonated peroxide | A heated mixture of hydrogen peroxide and carbon dioxide in ultrapure water in a circulating bath. | 5% $H_2O_2$ UPW pH = 4.5 | 80° C. | 60 |
| QDR | Ultrapure water in a quick dump rinse station | 100% UPW | Ambient | 10 |
| Megasonic + QDR | Ultrapure water in a megasonic cleaning station | 100% UPW | Ambient | 5 |
| Surfactant | An aqueous surfactant solution in a circulating bath. | 0.1% TX400 in UPW | Ambient | 60 |
| HFE + hot UPW | Hydrofluoroether in a circulating bath. | 100% HFE7100 | Ambient and 80° C. | 120 |
| Piranha | A mixture of sulfuric acid and hydrogen peroxide in a stagnant bath | 80% $H_2SO_4$ 20% $H_2O_2$ (30% in water) | 80° C. | 5 |
| Hot UPW | Heated ultrapure water in a circulating bath. | 100% UPW | 80° C. | 60 |
| Proprietary cleaner | A commercial cleaner used to purify fluoropolymer parts | — | — | — |

Process Effectiveness Test Methods

Tests to determine the effectiveness of various cleaning methods were performed in two steps. First, a variety of common cleaning solutions were used to clean two types of plastic semiconductor equipment components. In addition, one type of plastic component that had been heavily contaminated by handling was included. All of these initial-cleaning tests were run under the same conditions using multi-contaminant dynamic extraction (MCDE). The amounts of inorganic, organic and particulate contamination remaining after each cleaning process that could be extracted into water were measured. These results were the basis of a comparison of cleaning solution effectiveness. The more contaminant remaining, the less effective the cleaning method.

Multi-Contaminant Dynamic Extraction (MCDE)

The multi-contaminant dynamic extraction procedure (MCDE) is an on-line procedure for simultaneously measuring extractable organic and inorganic levels as well as particle shedding from a component with time. This technique measures the rate at which contaminants are extracted. This method has been developed with two main goals in mind: (1) to determine component cleanliness levels and (2) to evaluate various component-cleaning techniques to improve the cleanliness of the components. This technique has been used to evaluate the cleanliness of a variety of PFA resins and injection molded PFA parts as well as filters, valves, and machined fluoropolymer parts.

The method provides simultaneous on-line measurements of the current level of inorganics, organics, and particulate contaminants. The length of the test can be varied based on the cleanliness of the components being tested. The method gives a quick indication (<1 day) of whether a part is clean or contaminated. Although secondary sample analysis is not required to obtain information on the cleanliness of the part, samples may be drawn from the system at any time during testing to provide additional information about the chemical nature of the contamination. No hazardous chemicals are required since the system operates with ultrapure water.

MCDE Test System

The MCDE test setup is shown in FIG. 1. Components to be tested are placed in a loop of circulating ultrapure water (UPW). The resistivity, total organic carbon (TOC), and particle concentrations in the system are monitored to determine if inorganics, organics, and particles are extracted from the components over time. The test system consists of an UPW reservoir, pump, filter, parts chamber, a Thornton resistivity probe (to measure inorganics), PMS M65 laser particle counter, and an Anatel A-100 TOC analyzer to measure organics.

MCDE Test Procedure

The following description outlines the process of flushing and installing components in the system to begin a test. The test system is initially flushed with ultrapure water until the resistivity of the water in the system reaches 18.3 Mohm-cm. $N_2$ is slowly metered into the top of the reservoir and allowed to vent from the reservoir. The $N_2$ flow provides a nitrogen blanket for the system so that the resistivity of the UPW is not inadvertently degraded due to absorption of carbon dioxide from the ambient atmosphere.

The incoming UPW flow is then stopped. At this point, components are installed into the system. To do so, the pump is stopped and closing the isolation valve between the filter and the parts chamber isolates the parts chamber. Opening the sample/drain valve and closing the reservoir vent drains the parts chamber. The parts chamber is then removed to install components in the test chamber. The low $N_2$ flow into the reservoir blankets the UPW in the reservoir while the components are installed in the test chamber.

Alternatively, for flow-through components such as valves, the parts chamber is replaced by a spool piece during system flush up. Then, the spool piece is removed so that the flow-through component may be installed in its place. After the components have been installed, the parts chamber is purged with 10 l/min. of $N_2$ for several minutes through the blow-down port on the parts chamber to remove $CO_2$ added to the chamber during component installation.

Once the chamber or flow-through part has been purged, the isolation valve is opened and the pump is turned on to circulate water through the system at a flow rate of 1.01 l/min. If necessary, UPW is added until the reservoir is nearly full. Once all gag bubbles have been removed from the TOC analyzer and particle counter lines, testing is started. During all tests, the $N_2$ blanket is maintained to eliminate absorption of $CO_2$ by the water in the system. Both the particle counter and Anatel instrument return the sampled water to the reservoir so that all water and most contaminants are kept in the system. Tests were performed over 20–24 hours, but this time may vary depending on the cleanliness of the parts.

MCDE Data Analysis/System Background

To maintain a closed system and still be able to make measurements of TOC requires the return of UPW that had been sampled by the Anatel instrument back to the reservoir. Each time the Anatel instrument takes a sample, a valve closes, isolating the 7-ml sample volume. The ultraviolet radiation of the lamp breaks down the organics in the UPW thereby forming dissolved $C_2$ in the UPW in the form of carbonic acid. The TOC in the sample is determined by measuring the change in resistivity. After the measurement process is complete, the valve opens and the sample chamber is flushed. However, 7 ml of water with a reduced resistivity is added to the 4-liter system. The resistivity of the sample water exiting the Anatel instrument is related to the TOC in the system. For example, a TOC sample of 50 ppb would release about 7 ml of 2 Mohm-cm water into the system. The addition of this 7-ml of water reduces the resistivity of the system from 18.3 to about 18.0 Mohm-cm. The nitrogen blanket of the system may remove the carbonic acid, thereby eliminating the resistivity degradation problem due to the Anatel instrument. To reduce the effect of the Anatel instrument, the instrument is configured to sample only once per hour.

By breaking down the organic compounds each time a TOC measurement is made and returning the 7 ml of water back into the 4-liter system, the TOC in the system is reduced by about 0.2% per sample. This results in a reduction in TOC of 4.7% (7.0) in 24 hours and 28.6% (39.4) in 1 week.

System background tests are performed periodically to ensure that contamination is not being introduced by the components that make up the test system. Background tests are performed using the same procedure, except no parts are installed in the system. System water samples are analyzed for cations, anions, and trace metals.

Cleaning Effectiveness

MCDE test results: The amount of inorganic, organic and particulate contaminants removed in the MCDE tests by each cleaning solution was measured. Surface contaminants are shown in Tables 2 through 4; inorganic and organic contaminants in the bulk material are shown in Tables 5 and 6. The highlighted numbers in the tables indicate the cleaning solutions with the better performances. Blank cells in the table indicate that the part was not tested. Hot carbonated peroxide was among the most effective processes in most instances.

TABLE 2

Inorganic surface contamination remaining after cleaning as measured by MCDE

| | Surface contamination, ng (as NaCl)/cm$^2$ | | |
|---|---|---|---|
| Clean | New Part A | New Part B | Handled Part A |
| MCDE background | 8 | 8 | 8 |
| None | 185 | 450 | 750 |
| Carbonated peroxide | 175 | | |
| QDR | 75 | | |
| Megasonic | 75 | 45 | 65 |
| Surfactant | | | 110 |
| Piranha | 70 | | 50 |
| Hot UPW | 70 | | 80 |
| Hot carbonated peroxide | 75 | 45 | 150 |
| Megasonic plus hot carbonated peroxide | | | 65 |

TABLE 2-continued

| Inorganic surface contamination remaining after cleaning as measured by MCDE | | | |
|---|---|---|---|
| | Surface contamination, ng (as NaCl)/cm$^2$ | | |
| Clean | New Part A | New Part B | Handled Part A |
| Proprietary commercial cleaner | | 70 | |
| HFE plus hot UPW | | 85 | |

TABLE 3

| Organic surface contamination remaining after cleaning as measured by MCDE | | | |
|---|---|---|---|
| | Surface contamination, ng (as TOC)/cm$^2$ | | |
| Clean | New Part A | New Part B | Handled Part A |
| MCDE background | 6 | 7.5 | 6 |
| None | 80 | 30 | 135 |
| Carbonated peroxide | 20 | | |
| QDR | 15 | | |
| Megasonic | 10 | <5 | 5 |
| Surfactant | | | 10 |
| Piranha | | | <5 |
| Hot UPW | 30 | | 10 |
| Hot carbonated peroxide | 15 | <5 | 5 |
| Megasonic plus hot carbonated peroxide | | | 5 |
| Proprietary commercial cleaner | | 5 | |
| HFE plus hot UPW | | 10 | |

TABLE 4

| Particulate contamination remaining after cleaning as measured by MCDE | | |
|---|---|---|
| | Time (in minutes) to achieve specified addition rate of particles ≧0.1 μm | |
| Clean | <10/mL | <1/ml |
| None | 90 | 320 |
| Proprietary commercial cleaner | 120 | 500 |
| Megasonic | 25 | 65 |
| HFE+ Hot UPW | 10 | 35 |
| Hot carbonated peroxide | 5 | 30 |

TABLE 5

| Inorganic bulk contamination remaining after cleaning as measured by 24 hour MCDE tests | | |
|---|---|---|
| | Bulk contamination removed in MCDE test, ng (as NaCl)/cm$^2$ | |
| Clean | New Part A | New Part B |
| Background | 35 | 20 |
| None | 1500 | 25 |
| Carbonated peroxide | 1550 | |
| QDR | 1900 | |
| Megasonic | 1600 | 5 |
| Surfactant | | |
| Piranha | 1100 | |
| Hot UPW | 950 | |

TABLE 5-continued

| Inorganic bulk contamination remaining after cleaning as measured by 24 hour MCDE tests | | |
|---|---|---|
| | Bulk contamination removed in MCDE test, ng (as NaCl)/cm$^2$ | |
| Clean | New Part A | New Part B |
| Hot carbonated peroxide | 850 | 5 |
| Megasonic plus hot carbonated peroxide | | |
| HFE plus hot UPW | | 15 |
| Proprietary commercial cleaner | | 5 |

TABLE 6

| Organic bulk contamination remaining after cleaning as measured by 24 hour MCDE tests | | | |
|---|---|---|---|
| | Bulk contamination, ng (as TOC)/cm$^2$ | | |
| Clean | New Part A | New Part B | Handled Part A |
| Background | 20 | 2.5 | 20 |
| None | 135 | 5 | <5 |
| Carbonated peroxide | 75 | | |
| QDR | 80 | | |
| Megasonic | 65 | | <5 |
| Surfactant | | | <5 |
| Piranha | | | <5 |
| Hot UPW | 100 | | 5 |
| Hot carbonated peroxide | 60 | <5 | 5 |
| Megasonic plus hot carbonated peroxide | | | <5 |
| HFE plus hot UPW | | 10 | |
| Proprietary commercial cleaner | | <5 | |

In almost all cases the carbonated peroxide and hot carbonated peroxide cleaning solutions were as effective or more effective than the other cleaners evaluated.

EXAMPLE II

A second set of tests was performed to verify the MCDE results. The cleaning process that the MCDE tests deemed most effective were subjected to a DyconE$^{X\text{SM}}$ dynamic extraction procedure. The DyconE$^X$ procedure measures the contaminants extracted by 35% HCl, a far more powerful extractant than water. The amount of residual HCl-extractable contaminants following each of the cleaning procedures was used as a second measure of the effectiveness of each cleaning solution. Again, the more contaminants seen in the DyconE$^X$ procedure, the less effective the cleaning solution.

DyconE$^{X\text{SM}}$

DyconE$^{X\text{SM}}$ is a dynamic extraction procedure patented by FSI International (U.S. Pat. No. 5,641,895). It is a dynamic batch procedure designed to measure the accumulated mass of various metallic elements extracted from a test component by a semiconductor process fluid as a function of time. The extraction data are typically normalized to the surface area of the component that was in contact with chemical solution during the test. The rate of extraction, in terms of ng/cm$^2$-day, is determined by calculating the derivative of the curve obtained by plotting the normalized mass extracted as a function of time. The measured rates of extraction of individual metallic elements and the sum of all metallic elements at day 7 are compared to the requirements for the component. For example, FSI International's 1998 specification for total extractables at 7 days is less than or equal to 0.5 nanograms/cm$^2$/day.

The concept of DyconE$^X$ arose in response to the difficulty associated with evaluating data from conventional methods used to determine the extraction of metallic components. These methods typically involved contacting the component with the fluid for a given period of time and analyzing samples of the fluid before the test was initiated and after the test was completed (i.e. a 2-point test method). Due to stringent purity requirements, changes in metal concentrations on the order of the detection limits of the analytical procedure can be significant, and errors in sampling and analysis can easily confuse interpretation of results. These problems have been well documented in the literature. Data collected over time in the DyconE$^X$ procedure are well suited to regression analysis, which provides a statistical counterbalance to the errors associated with sampling and analysis. The reliability of the evaluation is greatly improved over two-point test methods.

The DyconE$^X$ procedure can be conducted quite simply in a static mode or, most advantageously, in a flow mode. Flow mode minimizes the liquid diffusion barrier to extraction. The DyconE$^X$ apparatus (flow mode) is typically configured to extract only the wetted surface of the component by connecting that component into a loop of circulating chemical in the same manner as the component would be used in the manufacturing facility. However, a fluid reservoir can also be inserted into the test apparatus and used to submerge a component for chemical extraction of all interior and exterior surfaces. Since the circulated chemical, typically concentrated hydrochloric acid, is highly corrosive, the system should be placed in a secondary containment enclosure.

DyconE$^X$ Test Procedure

Figure 2:
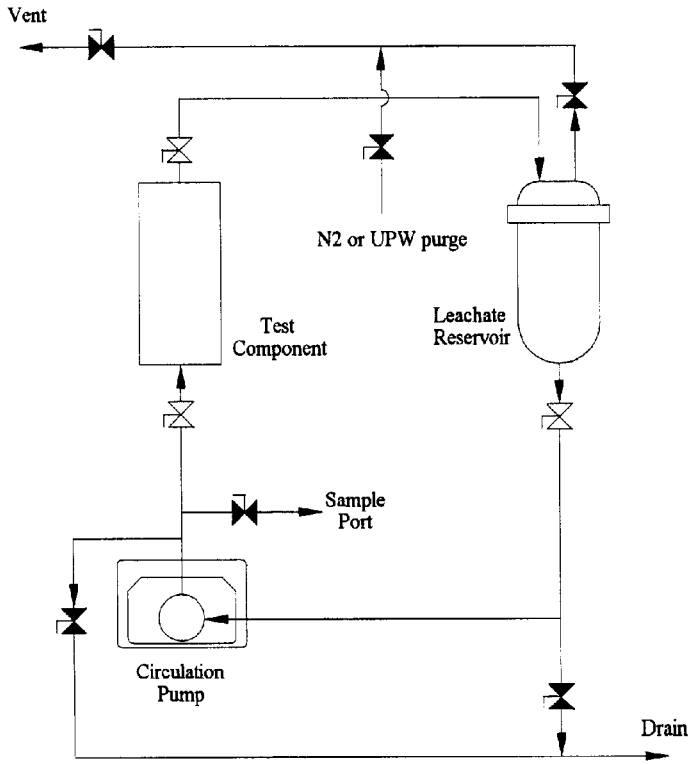
FIG. 2 is a schematic diagram of a DyconE$^{X^{SM}}$ test system used to evaluate cleaning solution performance.

The test apparatus is shown in FIG. 2. The procedure employs a pre-extracted, closed-loop test system that continuously circulates the extracting chemical through the test unit. The main components of the apparatus include a PFA chemical leachate reservoir and a circulation pump with a PTFE pump head. PFA tubing, fitting, and valves are used exclusively in the apparatus. Since the residence time in the chemical reservoir is on the order of minutes whereas the characteristic time required to detect measurable changes in concentration is on the order of hours, the system can be considered well mixed. The test is normally run for 10 days, and samples of circulating chemical are taken at several times throughout the test. Samples are analyzed by ICP-MS (inductively coupled plasma-mass spectroscopy) and GFAAS (graphite furnace atomic absorption spectroscopy) for the 20 metallic elements: Al, Ba, Be, B, Cd, Ca, Cr, Cu, Au, Fe, Pb, Li, Mg, Mn, Ni, K, Na, Sn, Ti and Zn.

The test procedure involves first filling the leachate reservoir with chemical. A typical chemical used for dynamic extraction is ultra-high purity, 35% hydrochloric acid, such as BASELINE Hydrochloric Acid from Seastar Chemicals, Inc. A control sample of chemical is taken directly from the reagent bottle for analysis. The circulation pump is started and the chemical solution is circulated through the system, which contains a clean pre-leached spool piece in place of the test component, for an hour before the pump is stopped. At this time a second control sample of chemical is taken from the reservoir for analysis as the system blank. The spool piece is then replaced with the test component and the pump is started to initiate the test. The first sample is taken at about 40 minutes to estimate surface contamination of the component, and serves as the initial or baseline sample for evaluation of the extraction of metals from this component. Subsequent samples, which represent extraction of metallic species from the bulk material of the component being tested, are taken at approximately 0.08, 0.4, 2 and 10 days from the time the first sample is drawn. The initial volume of chemical that is added, and the volumes of all samples withdrawn from the system, are recorded to ensure an accurate evaluation of the mass of metallics extracted, based on the analysis of samples from the system over time.

DyconE$^X$ Data Analysis

Metal extraction from the bulk material can be predicted from diffusion theory, which suggests that a reasonable approximation to the mass extracted as a function of time is provided by equation (3):

$$m=k\cdot t^n \tag{3}$$

where:

t=time (days)

m=normalized cumulative mass extracted (ng/cm$^2$) at time t k=proportionality constant n=exponent Taking the log of both sides of equation (3) gives:

$$\mathrm{Log}(m)=\log(k)+n\cdot\log(t) \tag{4}$$

The parameters in equation (3) for the metallic elements are obtained from a linear regression analysis of the normalized extraction data as a function of time plotted in log/log format. In this case, n is the slope and log k is the intercept as shown in equation (4).

This mathematical model assumes the extraction process can be approximated by diffusion from planar material with uniformly distributed contaminants, and is valid until most of the mass is extracted. The theory also predicts that the slopes of the extraction curves, plotted on log/log scale, should be 0.5. In many cases, the experimentally determined slopes can vary significantly from 0.5. The difference between prediction and observation may be due to the fact that the assumptions inherent in the theory are not met in practice.

The values for the constants k and n can be used to calculate the total mass extracted (for the 20 elements analyzed) from the test piece at different times by substituting these values into equation (3). In addition, the rate of extraction, expressed as ng/cm$^2$-day, can be determined by calculating the derivative of equation (3), as shown in equation (5):

$$\text{Rate of extraction}=dm/dt=n\cdot k\cdot t^{n-1} \tag{5}$$

The rate of extraction at any time can be calculated by substituting the values for the constants and the time into equation (5). A more detailed description of the data analysis procedure is given in the original patent.

DyconE$^x$ Test Results

As a second measure of cleanliness some of the cleaning solutions that were deemed effective by MCDE were tested using the DyconE$^x$ procedure. The results of this testing showed that the parts cleaned with hot carbonated peroxide contained the lowest levels of residual HCl-extractable contaminants (Table 7). The major metal ions detected were iron and aluminum.

If the contaminants on the exterior of a component are soluble in a cleaning solution, they are quickly removed. In this study, the contaminants removed in the first hour of the tests were considered to be surface contamination. Contaminants within the bulk material of the component require more time for extraction; thus, contaminants that are extracted after one hour are considered bulk contaminants.

TABLE 7

Residual contaminants of the new Part B extracted by the DyconE$^{X}$ procedure

| Cleaning Technique | Surface Metal Extraction (ng/cm$^2$) | Major Surface Contaminants | Bulk Metal Extraction in 10 days (ng/cm$^2$) | Total Mass Extracted in 10 days (ng/cm$^2$) | Major Bulk Contaminants |
|---|---|---|---|---|---|
| None | 22.3 | Fe, Al | 3.5 | 25.8 | Fe, Al, Cr |
| Proprietary Commercial Cleaner | 15.4 | Fe, Al, Cu, Na | 10.7 | 26.1 | Fe, Cr, Ca, Ni, Mg |
| Hot carbonated peroxide | 5.5 | Fe | 1.7 | 7.2 | Fe |

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. A cleaning solution composition for removing contaminants from items comprising:

(a) water;

(b) carbonic acid; and (c) hydrogen peroxide present at a solution concentration of 4% to 6% by weight, plus ozone at a saturation concentration.

2. The cleaning solution composition of claim 1, wherein carbonic acid is present in said cleaning solution in a concentration sufficient to produce a solution pH in the range 2.0 to about 6.0.

3. The cleaning solution composition of claim 2, wherein carbonic acid is present in said cleaning solution in a concentration sufficient to produce a solution pH in the range 2.0 to about 5.0.

4. The cleaning solution composition of claim 3, wherein carbonic acid is present in said cleaning solution in a concentration sufficient to produce a solution pH in the range 2.0 to about 4.5.

5. An acidic cleaning solution composition for use in semiconductor fabrication processes, for removing contaminants from items comprising:

(a) ultrapure water;

(b) carbonic acid present in said cleaning solution in a concentration sufficient to produce a solution pH in the range 2.0 to about 5.0; and (c) hydrogen peroxide present in said cleaning solution at a solution concentration of 4% to 6% by weight.

6. A cleaning solution composition for use in semiconductor fabrication processes and for removing contaminants from items comprising:

(a) ultrapure water;

(b) carbonic acid; and (c) hydrogen peroxide present at a solution concentration of 1–6 percent by weight.

7. The cleaning solution of claim 6, wherein said hydrogen peroxide is present at a solution concentration of 4–6 percent by weight.

8. A cleaning solution composition for use in semiconductor fabrication processes and removing contaminants from items comprising:

(a) ultrapure water;

(b) carbonic acid; and (c) ozone at a saturation concentration.

9. The cleaning solution of claim 8 wherein said carbonic acid is present in a concentration sufficient to produce s solution pH of 2–3.9.

* * * * *